US007084574B2

(12) United States Patent
Roach et al.

(10) Patent No.: US 7,084,574 B2
(45) Date of Patent: Aug. 1, 2006

(54) FLUORESCENT LIGHT POWER SOURCE FOR SUPPLYING POWER TO AN EXTERNAL DEVICE

(75) Inventors: Peter O. Roach, Atlanta, GA (US); Thomas J. Mayer, Wisconsin Dells, WI (US); Pierce J. Roberts, Jr., Amelia Island, FL (US)

(73) Assignee: NxSteps Communication, Inc., Atlanta, GA (US)

( * ) Notice: Subject to any disclaimer, the term of this patent is extended or adjusted under 35 U.S.C. 154(b) by 0 days.

(21) Appl. No.: 11/195,424

(22) Filed: Aug. 2, 2005

(65) Prior Publication Data

US 2005/0264224 A1 Dec. 1, 2005

Related U.S. Application Data

(62) Division of application No. 10/785,463, filed on Feb. 24, 2004, now Pat. No. 6,979,955.

(60) Provisional application No. 60/518,506, filed on Nov. 7, 2003, provisional application No. 60/513,720, filed on Oct. 24, 2003, provisional application No. 60/472,393, filed on May 22, 2003.

(51) Int. Cl.
*H01B 37/00* (2006.01)

(52) U.S. Cl. ..... 315/160; 340/311.01

(58) Field of Classification Search ..... 315/160, 315/291; 340/310.01
See application file for complete search history.

(56) References Cited

U.S. PATENT DOCUMENTS 23,335 A 3/1859 Oyamada et al.
30,367 A 10/1860 Belokin, Jr.
4,858,087 A 8/1989 Hartshorn
4,978,890 A 12/1990 Sekiguchi et al.
5,278,536 A 1/1994 Furtaw et al.
5,424,859 A * 6/1995 Uehara et al. ..... 398/127
5,548,494 A 8/1996 Blackman
5,612,593 A 3/1997 Olson
5,716,128 A 2/1998 Clark et al.

(Continued)

FOREIGN PATENT DOCUMENTS

JP 05-116282 5/1993

(Continued)

OTHER PUBLICATIONS

Flickenger, R., *Wireless Hacks. The NoCat Night Light: How Many Cats Does it Take to Screw in a Light Bulb?*, May 10, 2003, pp. 1-3.

*Primary Examiner*—Trinh Vo Dinh
(74) *Attorney, Agent, or Firm*—King & Spalding, LLP

(57) ABSTRACT

Systems and methods are provided for deriving power for an external device from the power source of a fluorescent light. The power source includes a fluorescent ballast electrically connected to the connectors of a light fixture for receiving an input voltage and for converting the input voltage to a lamp voltage suitable for powering a fluorescent lamp. The fluorescent ballast may be modified to include an output line that outputs a voltage for powering the external device to a power port. The power port may be mounted on or near the fluorescent light. Alternatively, the power port may be integrated within a housing that contains one of the connectors of the light fixture. The ballast may be further modified to include an output line for extracting network data and control signals from the power line carrier signals on the input voltage.

20 Claims, 6 Drawing Sheets

U.S. PATENT DOCUMENTS 5,806,760 A 9/1998 Maiello
5,822,361 A 10/1998 Nakamura et al.
5,926,301 A 7/1999 Hirt
6,005,884 A 12/1999 Cook et al.
6,222,503 B1 4/2001 Gietema et al.
6,400,968 B1 6/2002 White et al.
6,492,897 B1 * 12/2002 Mowery, Jr. ..... 455/522
6,539,028 B1 3/2003 Soh et al.
6,587,479 B1 7/2003 Bianchi et al.
6,758,697 B1 * 7/2004 Wu ..... 439/638
2003/0214399 A1 11/2003 Naruse et al.
2004/0061454 A1 * 4/2004 Prasad ..... 315/291
2004/0192227 A1 9/2004 Beach et al.
2005/0017656 A1 * 1/2005 Takahashi et al. ..... 315/248
2005/0231128 A1 * 10/2005 Franklin ..... 315/224

FOREIGN PATENT DOCUMENTS

JP 09-039272 2/1997
JP 2002-264366 9/2002

* cited by examiner

FLUORESCENT LIGHT POWER SOURCE FOR SUPPLYING POWER TO AN EXTERNAL DEVICE

RELATED APPLICATIONS

The present application is a divisional of U.S. Non-Provisional patent application Ser. No. 10/785,463 now U.S. Pat. No. 6,979,955 entitled "Deriving Power for a Wireless Network Component from the Power Source of a Fluorescent Light," filed Feb. 24, 2004, which claims the benefit of the following three provisional patent applications, each of which are incorporated herein by reference: (i) U.S. Provisional Patent Application Ser. No. 60/472,393 entitled "Methods and Apparatus for Attaching a Wireless Network Device to a Lighting Fixture to Derive a Power Source and a Mounting Fixture," filed May 22, 2003; (ii) U.S. Provisional Patent Application Ser. No. 60/513,720 entitled "Methods and Apparatus for Attaching a Network Device to a Fluorescent Lamp to Derive Power," filed Oct. 24, 2003; and (iii) U.S. Provisional Patent Application Ser. No. 60/518,506 entitled "Methods and Apparatus for Mounting a Wireless Device by Means of Attaching or Securing to a Fluorescent Lamp," filed Nov. 7, 2003.

TECHNICAL FIELD

The present invention relates generally to wireless networks and more particularly to the installation of wireless network components in a dwelling, commercial building, industrial facility, campus environment, tunnel, parking garages and other locations where gaps in wireless signal coverage may be prevalent or an increase in network capacity may be desirable.

BACKGROUND OF THE INVENTION

The term "wireless network" is used herein to refer to any network to which a wireless computing device or a wireless communications device can connect through wireless means. A wireless connection is commonly achieved using electromagnetic waves, such as radio frequency ("RF") waves, to carry a signal over part or all of the communication path. Wireless networks can be private or public in nature and can be designed for two-way communications or for one-way broadcasts. As wireless computing devices and wireless communications devices become more and more prolific, the demand increases for more ubiquitous access to these wireless networks.

Private wireless networks often serve a single building, campus or other defined location. To meet current government regulations for use of the radio frequency spectrum, a low signal transmit level is often used in these types of environments. This low transmit level allows the wireless signal to be effectively limited to the desired area by using walls, furniture, other obstructions, or even free space to attenuate and contain the signal. While a low transmit level works well to contain the wireless signal, it can also have the unintended consequence of allowing undesired gaps in the coverage area.

Wireless signal coverage gaps are also common in public networks. For example, two way communications networks, such as, cellular networks, PCS networks, paging networks, and mobile data networks, are often characterized by gaps in wireless signal coverage in areas such as tunnels, building lobbies, public gathering spaces, airports, public arenas, convention facilities, office spaces, etc. As another example, one way broadcast networks, such as satellite radio networks, GPS networks, or even AM radio stations, also tend to include wireless signal coverage gaps in areas such as buildings, public arenas, tunnels, or even under highway overpasses.

To provide wireless signal coverage within the gaps of a wireless network or to add traffic carrying capacity, additional network equipment is usually required. A common method of covering a gap or adding capacity is to place an additional network access point, such as a base station, in a location where it can communicate with one or more wireless computing device or wireless communications device located in or near the gap. A network access point may or may not require a dedicated hard-wired communications facility to or from the hardwired network. Adding network access points to a wireless network can allow additional communication channels to be added to the wireless network and usually allows additional traffic carrying capacity to be added as well. Both wired and wirelessly interconnected network access points are well known in the art.

In locations where additional channels or traffic carrying capacity is not needed on the wireless network, a wireless repeater, wireless reradiator, or wireless signal booster can be used to cover a gap. Usually a wireless repeater, wireless reradiator, or wireless signal booster receives the wireless signal over the air and then repeats the wireless signal or regenerates the wireless signal on either the same channel or another wireless channel. Wireless repeaters, wireless reradiators, and wireless signal booster are well known in the art. The benefits of using a wireless repeater, wireless reradiator, or wireless signal booster instead of a network access point can be a reduction in cost, size, power consumption and/or the lack of a need for a back-haul communications facility to the network.

Hereinafter, network access points, wireless repeaters, wireless reradiators, wireless signal boosters and other wireless network devices, such as hubs, routers gateways, etc. are referred to collectively as "wireless network components." In many cases the optimal location for a wireless network component, for purposes of maximizing wireless signal coverage, is an overhead location. Unless a building or other structure is pre-wired to accommodate the installation of wireless network components in overhead locations, commercial power sources will typically not be readily available in such overhead locations. To install a wireless network component in an overhead location, a commercial power line must be run to the overhead location or the wireless network component must be designed to work off of an alternative power source, such as solar power, battery power, a power generator, or the like.

The cost of running a commercial power line or providing alternative power to a wireless network component often far eclipses the cost of the network component itself, and thus renders implementation impractical for many applications. Also, hard-wiring of the wireless network component to the commercial power supply or installing a new electrical outlet for the wireless network component makes it more difficult to rapidly reconfigure the wireless network by moving the wireless network component to another location. Since wireless coverage is often difficult to predict and because changes in the environment can adversely impact the coverage, capacity and/or quality of a wireless system, it is often necessary to change the location of a wireless network component from time to time. If the wireless network component is designed to be permanently connected to a power supply, requires special skills to relocate, or is not otherwise easily relocated or moved, the network administrator may tend to sub-optimize the network coverage or capacity due to the expense and/or difficulty of making rapid reconfigurations.

In most overhead locations where a wireless network component is desirable, a lighting source is usually available. For example incandescent lights are commonly available in homes. Compact electric discharge lamps, hereinafter referred to generally as "fluorescent lamps," are commonly available in office complexes, industrial buildings, manufacturing facilities, parking garages, airports and other locations. Other types of well known lighting sources are spot lights commonly available on the external walls of dwellings and businesses, street lights commonly available in neighborhoods, and security lights commonly available in campus environments or the external areas of commercial facilities. Usually most of these lighting sources have ample power available to power the existing lighting as well as another device.

It is known in the art that a wireless network component can be mounted and electrically connected between an incandescent light fixture and an incandescent light bulb. For example, the wireless network component can be fitted on one side with a "male" coupling that screws into the light socket. On the opposite side, the wireless network component can be fitted with a female coupling into which the light bulb can be screwed. The male and female couplings can be electrically connected to the input and output power lines of the wireless network component to complete a circuit. Such a configuration is shown in U.S. Pat. No. 6,400,968 issued to White, et al.

Fluorescent lights, however, are more prevalent than incandescent lights in business facilities, airports, commercial and industrial buildings and other locations where wireless network coverage is more likely to be needed. As used herein, the term "fluorescent light" is intended to encompass the fluorescent light fixture and the fluorescent lamp. Fluorescent light fixtures designed for linear fluorescent lamps include laterally spaced connectors that receive the pin or pins protruding from each end of the fluorescent lamp. The lateral space between said connectors is typically substantially equivalent to the length of the fluorescent lamp. Thus, due to space constraints, there is not a simple way to mount and electrically connect a wireless network component in between the fluorescent light fixture and the fluorescent lamp. Similar space constraints exist within fluorescent light fixtures designed for U-bent fluorescent lamps, Circline fluorescent lamps, etc.

Florescent lights are known to generate RF noise, which can cause harmful interference to the normal operations of electronic devices and radio transmitters. This noise is generally a result of the proper operation of either the fluorescent power supply or the fluorescent lamp itself.

Accordingly, there is a need to overcome the limitations of the prior art by adapting a wireless network component to utilize the power source of a fluorescent light that is readily available in many overhead locations. There is an additional need for adapting a wireless network component to utilize the power source of a fluorescent light while reducing or minimizing the impact on the wireless network component of RF noise generated by the fluorescent light.

SUMMARY OF THE INVENTION

The present invention satisfies the above-described need by providing systems and methods for deriving power for a wireless network component, or other device, from the power source of a fluorescent light. In accordance with certain aspects of the invention, a first power coupling is electrically connected to at least a first pin of a fluorescent lamp and to a power converter of the wireless network component. A second power coupling is electrically connected to at least a second pin of the fluorescent lamp and to the power converter of the wireless network component device, such that a circuit is completed between the power converter, the first pin and the second pin. Power supplied to the pins by the power source of the fluorescent light will be drawn by the circuit to power the wireless network component. The fluorescent lamp still receives sufficient power to provide at least some of the intended illumination.

On linear fluorescent lamps, the first pin may be located at a first end of the fluorescent lamp and the second pin may be located at a second end of the fluorescent lamp. In the case of linear fluorescent lamps, the first power coupling is spaced apart from the first end of the fluorescent lamp and from a first connector in the fluorescent light fixture by one or more first insulating means. Similarly, the second power coupling is spaced apart from the second end of the fluorescent lamp and from a second connector in the fluorescent light fixture by one or more second insulating means. The first power coupling and the second power coupling may each be configured for making electrical connection with one or more of a bi-pin fluorescent lamp, a single-pin fluorescent lamp or any pin or other connector configuration for linear fluorescent lamps. On other types of fluorescent lamps, such as U-bent or Circline lamps, the first pin and the second pin may both be located at a first end of the fluorescent lamp. In such a case, the first power coupling and the second power coupling may both be spaced apart from the first end of the fluorescent lamp and from a connector in the fluorescent light fixture by one or more insulating means.

At least one of the first power coupling or the second power coupling may be electrically connected to the power converter of the wireless network component via a power tether. Alternatively or in addition, at least one of the first power coupling and/or the second power coupling may be electrically connected directly to the power converter of the device. The wireless network component may be configured to receive network data and control signals from a second wireless network component via wireless communications. Alternatively or in addition, the wireless network component may be designed to communicate with a second network component via a power line carrier system.

Another aspect of the invention allows a power coupling to be inserted between one of the ends of a fluorescent lamp and the connectors within a fluorescent light fixture. In this configuration a circuit is completed between the power coupling, the pins of the fluorescent lamp and the connectors of the fluorescent light fixture. The power coupling is electrically connected to a wireless network component, which may be mounted in, on or near the fluorescent light fixture. Similarly, a power coupling may be inserted between two connectors within a fluorescent light fixture. In this configuration a circuit is completed between the power coupling and the connectors of the fluorescent light fixture. The circuit may terminate in a plug or other power port. A wireless network component mounted in, on or near the fluorescent light fixture may be electrically connected to the power port by way of a power cord, etc.

In accordance with other aspects of the invention, a power source of a fluorescent light is configured for supplying power to a wireless network component or other external device. The power source of the fluorescent light includes a fluorescent ballast for receiving an input voltage via an input line and for converting the input voltage to a lamp voltage suitable for powering a fluorescent lamp. The power supply also includes a first output line electrically connecting the fluorescent ballast to the connectors, which are designed primarily to receive the pins of a fluorescent lamp, within a light fixture for outputting the lamp voltage to the connector. In addition, the power supply includes a second output line electrically connecting the fluorescent ballast to a power port for outputting an external device voltage, which is suitable for powering the external device, to the power port. The power port may be integrated within a housing that contains one of the connectors that receives the pins of a fluorescent lamp. The power port may alternatively be mounted on or near the light fixture.

The power source of the fluorescent light may also include a third output line for extracting network data and control signals from power line carrier signals on the input voltage. The power source may further include a signal bypass network electrically connected to the input line and to at least one of the first output line and the second output line for allowing power line carrier signals to bypass the fluorescent ballast.

In accordance with still other aspects of the present invention, a wireless network component that derives power from the power source of a fluorescent light includes: a first power coupling that is electrically connected to the power converter of the wireless network component and which is configured for electrically connecting to a first connector within a fluorescent light fixture; a second power coupling that is electrically connected to the power converter of the wireless network component and which is configured for connecting to a second connector within the fluorescent light fixture to thereby complete a circuit between the power converter, the first connector and the second connector. Power supplied to the first connector and second connector by the power source of the fluorescent light will be drawn by the circuit to power the wireless network component.

The wireless network component may be housed in a housing shaped substantially similar to a fluorescent lamp. In such a configuration, the first power coupling is positioned at a first end of the housing and the second power coupling is positioned at a second end of the housing. The first power coupling and the second power coupling may each be shaped to mimic one or more pin of a fluorescent lamp. The housing may include a compartment for receiving and powering a fluorescent lamp having the same style and form factor as the fluorescent lamp intended for the fluorescent light fixture or one or more fluorescent lamp that is shorter than intended for the fluorescent light fixture. In that case, one of the power couplings may be electrically connected to the power converter of the wireless network component via the short fluorescent lamp. The wireless network component may also include at least one external antenna, which may or may not be removable.

Another aspect of the present invention provides methods and components for reducing or minimizing the effect of noise that the power source of a fluorescent light will inevitably introduce to the power lines (e.g., circuits, power converter feeds, associated power tethers, etc.) of the wireless network component. The noise is dampened by grounding one or more power line of the wireless network component to a ground source through at least a portion of the florescent light fixture or through the ground of the florescent light power source. The wireless network component may include grounding components comprising a ground wire or other grounding means, a capacitor or similar component for avoiding coupling of significant amounts of electrical current. The ground wire or other grounding means may be designed for temporary contact with the grounding source, to allow for relocation of the wireless network component as needed or desired.

These and other aspects, features and embodiments of the present invention will become apparent to those skilled in the art upon consideration of the following detailed description of illustrated embodiments exemplifying the best mode for carrying out the invention as presently perceived.

DETAILED DESCRIPTION OF EXEMPLARY EMBODIMENTS

Figure 1:
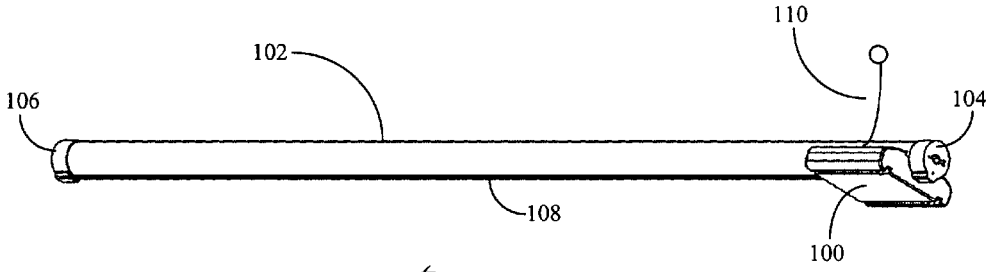
FIG. 1 is an illustration of an inventive wireless network component mounted to a fluorescent lamp and configured for drawing power therefrom, in accordance with certain embodiments of the present invention.

The present invention provides systems and methods for powering a wireless network component with power drawn from a fluorescent light. In accordance with certain embodiments of the invention, a wireless network component may be configured to draw power from the pins of a fluorescent lamp. In accordance with other embodiments, a wireless network component may be configured to interface directly with the lamp connectors (also referred to as contacts) in the fluorescent light fixture. In either configuration, the invention allows a wireless network component to derive the power needed for its own operation, while still allowing the fluorescent lamp to provide illumination to the intended area.

A wireless network component according to the present invention derives its power directly from a fluorescent light without the need for additional electrical wiring. This eliminates the need for highly skilled labor to install the wireless network component. Installation of the inventive wireless network component does not require any additional skills or specialized tools beyond those required to replace a fluorescent lamp. This ease of installation enables a network administrator to easily expand the coverage of a wireless network by adding additional wireless network components as necessary or desired. In addition, the inventive wireless network component can be relocated from one fluorescent light to another, allowing a network administrator to easily reconfigure the coverage pattern of the wireless network.

In certain other embodiments of the present invention, the ballast of a fluorescent light fixture can be reconfigured to provide power to both the fluorescent lamp and an external device, such as wireless network component. The reconfigured ballast may include a power outlet or other power coupling for interfacing with the wireless network component. The power coupling may be located within the fluorescent light housing or provided as an addition to the connectors used to mount the fluorescent lamp. In this manner, once the reconfigured ballast and power coupling are installed in a light fixture, a wireless network component can be easily added or moved.

The present invention presumes that the wireless network component is mounted in a suitable overhead location on or near the fluorescent light. Preferred methods and structures for mounting a wireless network component on a fluorescent light are described in co-pending U.S. patent application Ser. No. 10/790,644, filed Mar. 1, 2004, which is commonly owned by the present assignee and incorporated herein by reference in its entirety. However, other methods for overhead mounting of a wireless network component are possible, including but not limited to the use of brackets, adhesives, magnetic couplings, screws, nails and other fasteners, hooks, etc. It should therefore be appreciated that the present invention is not limited to any particular mounting configuration of a wireless network component.

As mentioned previously, certain wireless network components may function as base stations, wireless hubs, or wireless routers. Thus, in certain embodiments, it may be necessary for the wireless network component to receive control and transport signals from the wireless network. As an example, the wireless network component may communicate with the wireless network via a traditional hard-wired facility, such as Ethernet, telephone cable, T-1, or other similar means. As an alternative example, the wireless network component may communicate with the wireless network using a power line carrier system. Power line carrier systems, which are well know in the art, allow a broadband data signal to be transported via the power lines as a distribution type network. A typical power line carrier system is described in U.S. Pat. No. 6,492,897 to Mowery, Jr., which is incorporated herein by reference.

To avoid running a hard-wired communications facility to a wireless network component, or connecting the wireless network component to a power line carrier system, the wireless network component may alternatively communicate with the wireless network via in-band wireless, out of band wireless, free space optical, infrared, or any other suitable wireless communication technology. In certain embodiments, the wireless network component may be designed to communicate with one or more other wireless network component via free space optical or infrared devices positioned above the plenum ceiling or otherwise. Such a configuration could allow the wireless network component to derive power from a fluorescent light while inconspicuously and receiving wireless data and control signals from another wireless network component. Wireless communications between the wireless network component and the wireless network allow the wireless network component to be more easily moved from one location to another.

Referring now to the attached figures, in which like numerals represent like elements, certain exemplary embodiments of the present invention will hereafter be described. FIG. 1 shows an inventive wireless network component 100 mounted to a fluorescent lamp 102 and configured for drawing power therefrom. A first power connector cap 104 fits over one end of the fluorescent lamp 102 and includes a power coupling that makes electrical connection with at least one pin (not shown) on that end of the fluorescent lamp 102. A second power connector cap 106 fits over the other end of the fluorescent lamp 102 and includes a power coupling that makes electrical connection with at least one pin (not shown) on that end of the fluorescent lamp 102. The power couplings within the power connector caps 104, 106 are electrically connected to the power converter (sometimes referred to as a power supply unit) of the wireless network component 100. For example, a power tether 108 (i.e., a power cord, wire, conductive strip, etc.) may connect one power connector cap 106 to the power converter of the wireless network component 100. The other power connector cap 104 may also be connected to the power converter of the wireless network component 100 by another power tether (not shown) or may be directly connected thereto or integrated therewith.

The use of the power connector caps 104,106 and the one or more power tether 108 allows the wireless network component 100 to be installed when the fluorescent lamp 102 is not installed in the light fixture. In other embodiments, the power connector caps 104,106 and possibly the power tether 108 can be incorporated directly into the fluorescent lamp. A power tether 108 may be expandable and/or retractable so as to provide greater flexibility for use with different length fluorescent lamps 102 and/or positioning of the wireless network component 100 along the length of a fluorescent lamp 102.

When drawing power from a fluorescent lamp 102 for a wireless network component 100, a major obstacle to overcome is the amount of noise present in the circuit. The present invention overcomes this obstacle by grounding the circuit back to a metal surface within the housing of the fluorescent light fixture. An exemplary grounding means, a ground wire 110, is shown in FIG. 1. The ground wire 110 may be passed through a capacitor before connecting to the housing of the light fixture, to further dampen the RF noise that results from proper operations of a fluorescent light. The ground wire 110 is, in the preferred implementation, a spring steel wire designed to touch the fluorescent light fixture to provide the grounding means. Other methods for grounding the wireless network component 100 will occur to those of ordinary skill in the art, including but not limited to use of a grounding screw wired to the wireless network component 100, use of a webbed mesh tether, use of a conductive bar, or use of other similar means.

Figure 2:
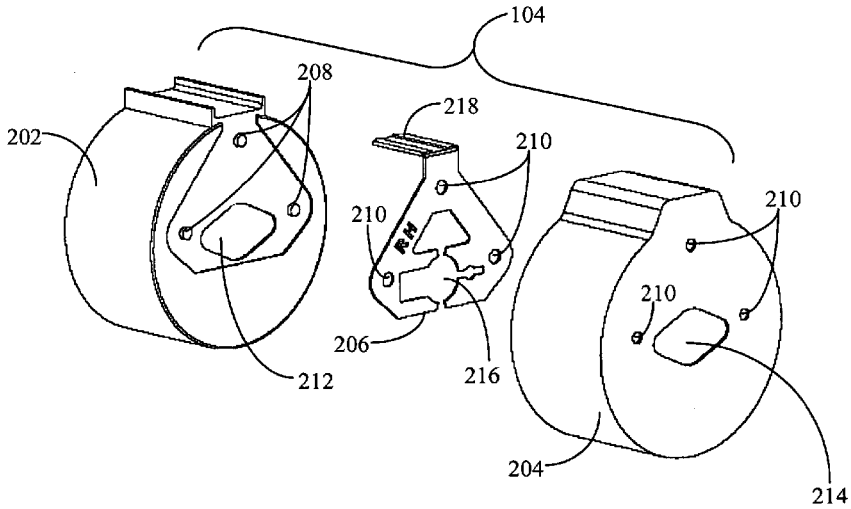
FIG. 2 is an illustration of an exemplary power connector cap used to draw power from a fluorescent lamp, in accordance with certain embodiments of the present invention.

FIG. 2 shows an exemplary power connector cap 104 of the present invention. The exemplary power connector cap 104 consists of three components: an inside connector cap 202, an outside connector cap 204, and a power coupling 206. The inside connector cap 202 and the outside connector cap 204 are constructed of plastic or another suitable insulating material. The power coupling 206 is constructed of a conductive material, such as copper.

The inside connector cap 202 may be designed to include one or more alignment pin 208. The outside connector cap 204 and the power coupling 206 may each be designed to include one or more corresponding alignment holes 210. Accordingly, the three components may be aligned for assembly using the one or more alignment pin 208 and the corresponding alignment holes 210. The one or more alignment pin 208 may optionally be designed to snap into the corresponding alignment holes 210. Alignment pins 208 and alignment holes 210 are optional features of the invention and are provided merely for ease of assembly. Alternatively, alignment markings or other alignment indexes may be supplied to facilitate proper assembly of the exemplary power connector cap 104. Furthermore, the exemplary power connector cap 104 may by designed without any alignment pins 208, alignment holes 210 or other alignment indexes. In other embodiments, or conductive material of the power coupling 206 may be coated with a nonconductive material, such as plastic, eliminating the need for one or more of the inside connector caps 202 and the outside connector cap 204.

The inside connector cap 202, the outside connector cap 204 and the power coupling 206 each include a center passage 212, 214, 216 through which the pins of the fluorescent lamp 102 will pass. The center passage 216 of the power coupling 206 is shaped so that at least one pin of the fluorescent lamp 102 makes electrical contact with the power coupling 206. As shown in FIG. 2, the center passage 216 of the power coupling 206 may be shaped so as to be capable of making electrical contact with one pin of a bi-pin fluorescent lamp 102 or the pin of a single-pin fluorescent lamp 102. Such a configuration allows the same power coupling 206 to be used with either type of fluorescent lamp 102. If other configurations are used, it may be necessary to swap out the power coupling 206 from the power connector cap 104 depending on the type of fluorescent lamp. Electrically connecting to only one pin of a bi-pin fluorescent lamp 102 may be desirable in certain embodiments to avoid shorting the pre-heat mechanism common to some fluorescent lights.

The power coupling 206 is connected to the power converter of the wireless network component 100, either directly or by using a power tether 108, via a connector 218. The connector 218 may be configured as a pin, clip, plug, or any other suitable electrical connection mechanism. Thus, when power is supplied to the fluorescent lamp 102, power flowing across at least one pin of the fluorescent lamp 102 is drawn by the power coupling 206 and is directed to the power converter of the wireless network component 100. A second power coupling (not shown) connected to the power converter of the wireless network component 100 and to a pin on the opposite end of the fluorescent lamp 102 completes the circuit.

Figure 3:
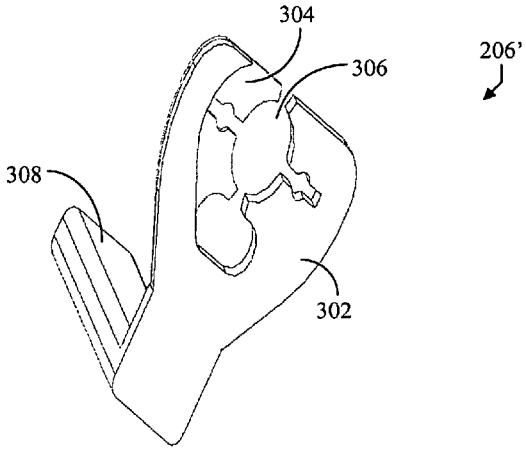
FIG. 3 is an illustration of an exemplary power coupling used to draw power from a fluorescent lamp, in accordance with certain embodiments of the present invention.

FIG. 3 illustrates an alternative power coupling 206' that may be used within an alternative power connector cap assembly (not shown) or in place thereof. The alternative power coupling 206' has a layered construction, including at least a first insulating layer 302 (e.g., made of plastic) and a conducting layer 304 (e.g., made of copper). A second insulating layer (not shown) may also be provided, to sandwich the conducting layer 304 between the first insulating layer 302 and the second insulating layer. The one or more insulating layer 302 may, in some embodiments, take the place of the inside connector cap 202 and/or the outside connector cap 204 described in FIG. 2. In other embodiments, an inside connector cap 202 and/or an outside connector cap 204 may be used in conjunction with the alternative power coupling 206'.

The alternative power coupling 206' includes a center passage 306 through which the pin or pins of a fluorescent lamp 102 pass. The center passage 306 is shaped so that at least one pin of the fluorescent lamp 102 makes electrical contact with the conducting layer 304. As shown in FIG. 3, the center passage 306 may be shaped so that one pin of a bi-pin fluorescent lamp 102 makes electrical contact with the conducting layer 304 and the other pin makes contact with the insulating layer 302. The center passage 306 may also be shaped so that the pin of a single-pin fluorescent lamp would contact at least a portion of the conducting layer 304 and possibly a portion of the insulating layer 302. Again, the illustrated configuration of the center passage 306 is intended to allow use of the same power coupling 206' with both bi-pin and single-pin fluorescent lamps 102. Other configurations of the center passage 306 may provide the alternative power coupling 206' with even greater universality. For example, the conducting layer 304 may be designed to be moveable or adjustable so that its position or shape can be changed to accommodate different pin sizes and arrangements. One skilled in the art will appreciate that a power coupling 206, 206' can be constructed to accommodate any number of other pin (or other type of connector) configurations for fluorescent lamps.

The alternative power coupling 206' is connected to the power converter of the wireless network component 100, either directly or by using a power tether 108, via a connector 308. The connector 308 may be configured as a pin, clip, plug, or any other suitable electrical connection mechanism. When power is supplied to the fluorescent lamp 102, power flowing across at least one pin of the fluorescent lamp 102 is drawn by the alternative power coupling 206' and is directed to the power converter of the wireless network component 100. A second alternative power coupling (not shown) may be connected to the power converter of the wireless network component 100 and to a pin on the opposite end of the fluorescent lamp 102 to complete the circuit.

The exemplary power connector caps 104, 106 and power couplings 206, 206' shown in FIGS. 1–3 are provided by way of illustration only. Many other designs and configurations are possible, all of which are considered to be within the scope of the present invention. By way of example, a power coupling 206, 206' may be designed to make electrical contact with two pins on each end of a bi-pin fluorescent lamp 102. A power coupling 206, 206' may alternatively be configured to draw power from a single end of a fluorescent lamp 102. One skilled in the art could further extrapolate the inventive concepts described herein to design different types of power connector caps 104, 106 and a power coupling 206, 206', or even build such components directly into or onto a fluorescent lamp 102. In other embodiments, one or more power coupling 206, 206' can be used to electrically connect the power converter of the wireless network component 100 to any two points within the circuit that supplies power from the fluorescent light power source to the fluorescent lamp, thereby creating a second circuit to supply power to said power converter. Accordingly, the present invention is not intended to be limited to any particular shape, configuration, style or placement of components used for drawing power from a fluorescent lamp 102.

Figure 4:
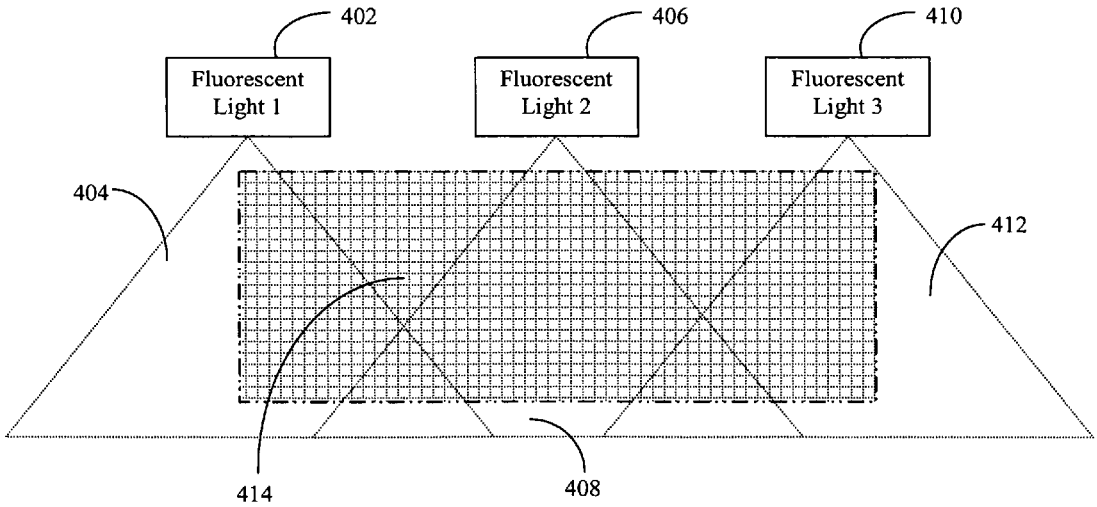
FIG. 4 is a block diagram generally illustrating the abundance of location choices for a wireless network component powered from a fluorescent light.

Mounting a wireless network component 100 to a fluorescent light provides an abundance of location choices for the wireless network component 100, as generally illustrated in FIG. 4. Fluorescent lights are typically spaced at regular or irregular intervals within the overhead space of a typical office space, airport, industrial space, etc. In the illustrated example, mounting a wireless network component 100 to a first fluorescent light 402 would provide a first potential wireless coverage area 404; mounting the wireless network component 100 to a second fluorescent light 406 would provide a second potential wireless coverage area 408; and mounting the wireless network component 100 to a third fluorescent light 410 would provide a third potential wireless coverage area 412. A desired wireless coverage area 414 may overlap the first potential wireless coverage area 404, the second potential wireless coverage area 408 and the third potential wireless coverage area 412.

Of the three potential wireless coverage areas 404, 408, 412, it can be seen that the second potential coverage area 408 provides the most overlap with the desired coverage area 414 in the example of FIG. 4. Therefore, the second fluorescent light 406 may be the optimal location for mounting the wireless network component 100. However, due to anomalies in the environment and the nature of radio frequency communications, a network administrator might determine that mounting the wireless network component 100 to either the first fluorescent light 402 or the third fluorescent light 410 will better serve the desired coverage area 414. Due to the fact that the wireless network component 100 of the present invention is designed to easily connect to and disconnect from a fluorescent lamp 102, the network administrator can easily move the wireless network component 100 between the available fluorescent lights 402, 406, 410 to determine the optimal mounting location. Of course, additional wireless network components 100 could be added to one or more additional fluorescent lights 402, 406, 408 to completely cover any gaps in the wireless network.

Figure 5:
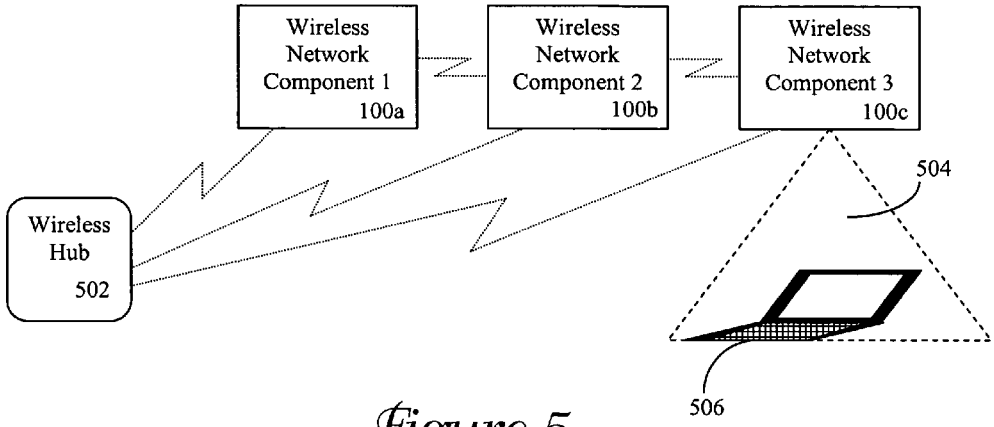
FIG. 5 is a block diagram illustrating an embodiment in which wireless network components powered from fluorescent lights function as network access point.

FIG. 5 illustrates an embodiment in which wireless network components 100*a–c* function as network access point that communicate wirelessly with a wireless hub 502. Each wireless network component 100*a–c* provides a wireless coverage area. For example, wireless network component 100*c* provides the illustrated wireless coverage area 504, in which a wireless computing device 506 or a wireless communications device can gain access to the wireless network through that wireless network component 100*c*. Backhaul for the wireless network component's 100*c* data and control signal are provided via a wireless link to the wireless hub 502. In other embodiments, each wireless network component 100*a–c* may be configured for communicating with each other. In such embodiments, the wireless network component 100*a–c* can form and/or support a mesh network.

Figure 6:
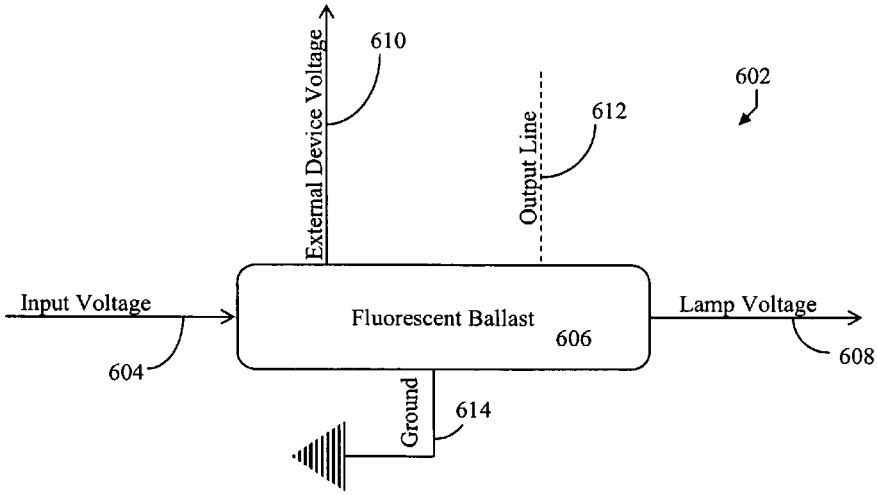
FIG. 6 is a block diagram illustrating a power supply of a fluorescent light fixture that is reconfigured to provide an additional output voltage for powering an external device, in accordance with certain embodiments of the present invention.

In alternative embodiments of the present invention, power for a wireless network component 100 may be drawn from the power supply of a fluorescent light, as opposed to the pins of the fluorescent lamp 102. FIG. 6 is a block diagram illustrating a power supply 602 of a fluorescent light fixture that has been reconfigured to provide an additional output voltage for powering a wireless network component 100 or other external device. In any standard fluorescent light fixture, input voltage 604 (i.e., from an A/C power supply) is supplied to a ballast 606. The ballast 606 is responsible for converting the input voltage 604 to the lamp voltage 608, i.e., the voltage required to illuminate a fluorescent lamp 102. The ballast 606 may be configured to provide an additional output voltage, referred to herein as the external device voltage 610, which can be supplied to an external device, such as a wireless network component 100, via suitable electrical connectors. The ground 614 of the power supply 602 may be established by way of physical contact with the casing of the power supply 602.

In embodiments where the wireless network component 100 is used in connection with a power line carrier system, the ballast 606 may further be configured with a separate output line 612 for data and control signals. Such a configuration allows a power line carrier signal to be separated from the input voltage 604 before the voltage is converted and supplied to the fluorescent lamp 102 or the external device. Thus, the separate output line 612 would allow a clean data and control signal to be isolated before power supply noise is introduced. In this manner, a greater data and control signal throughput may be possible. One skilled in the art will appreciate that the data and control signal can also or alternatively be output from the power supply 602 using a power line carrier signal on the external device voltage 610.

Figure 7:
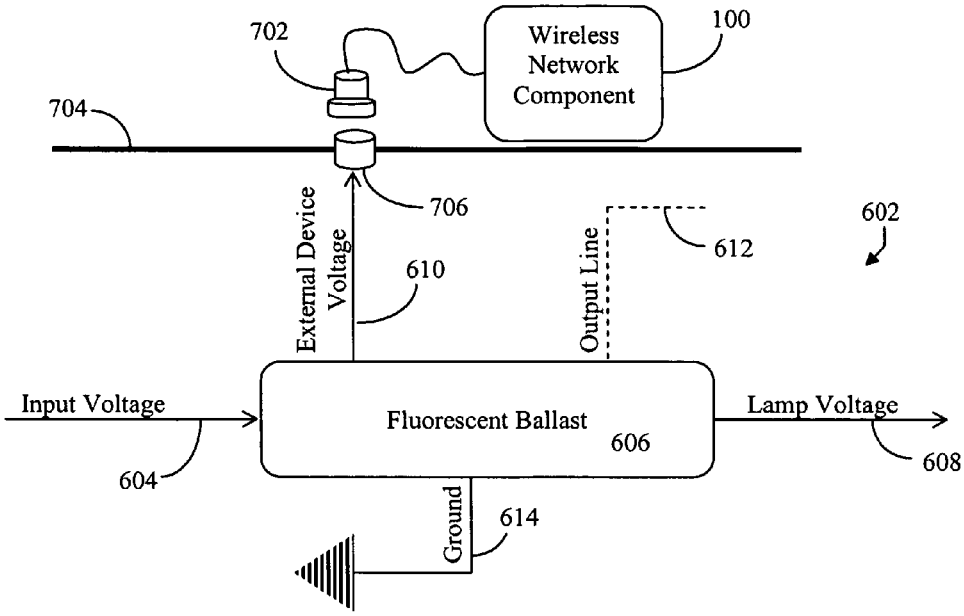
FIG. 7 is a block diagram illustrating one exemplary embodiment of the fluorescent power supply shown in FIG. 6.

FIG. 7 illustrates one exemplary embodiment of the fluorescent power supply 602 shown in FIG. 6. The ballast 606 of the fluorescent power supply 602 receives an input voltage 604 and outputs the lamp voltage 608 and the external device voltage 610. The external device voltage 610 is supplied to a socket 702, (or plug or other power port) that may be mounted on or near the housing 704 of the fluorescent light fixture. The socket 702 may be designed to receive a plug 706 (e.g., a power tether 108) that is connected to the power supply of the wireless network component 100 or other external device. Using this configuration, the wireless network component 100 or other external device can be easily plugged into and unplugged from the socket 702 for rapid installation and/or relocation.

Figure 8:
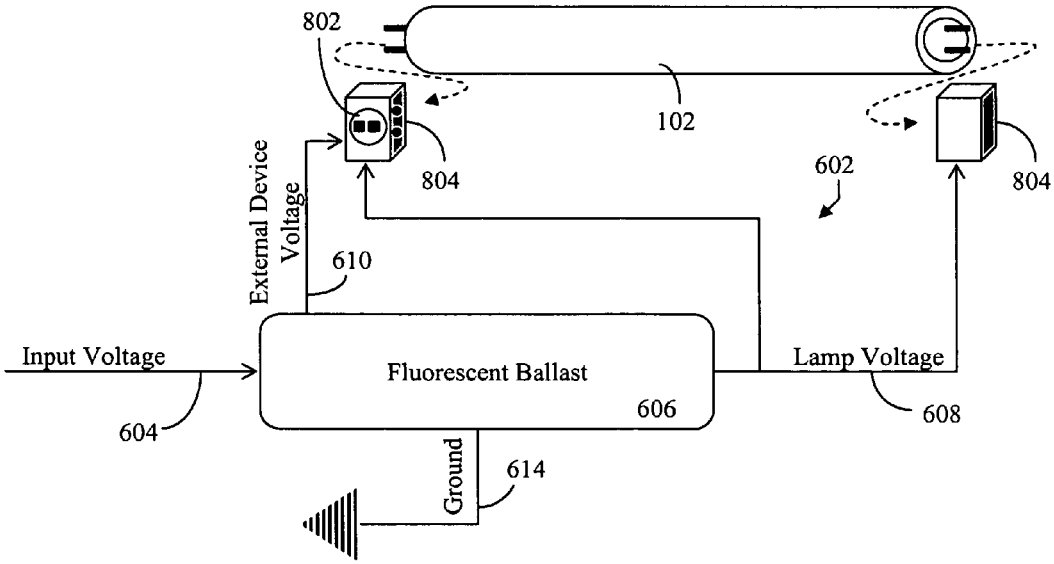
FIG. 8 is a block diagram illustrating an exemplary variation of the fluorescent power supply shown in FIG. 7.

FIG. 8 illustrates a variation of the embodiment described with respect to FIG. 7. As shown, a socket 802 (or plug or other power port) for providing power to an external device may be positioned within or near a housing that contains the connectors 804 (e.g., receptacles) that receive the pins of one end of a fluorescent lamp 102. Again, the power supply 602 includes a ballast 606. The ballast 606 receives the input voltage 604 and provides lamp voltage 608 to the fluorescent lamp 102 via the connectors 804, 806 that form part of the fluorescent light fixture. In addition, the ballast 606 may output the external device voltage 610 to a socket 802 integrated into or attached to the housing of one of said connectors 804.

Figure 9:
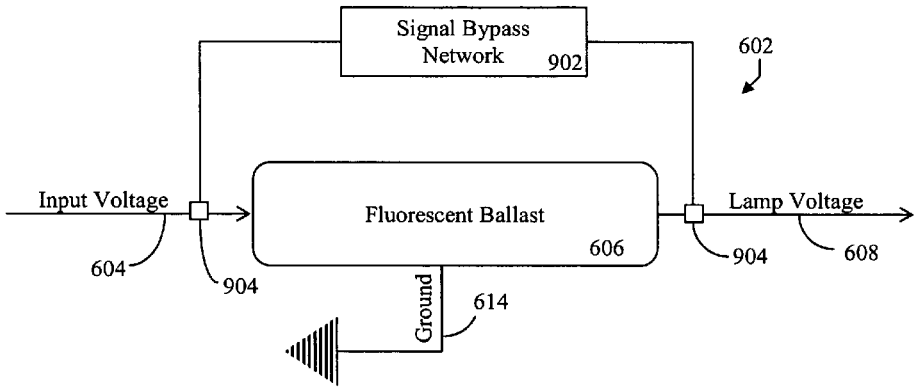
FIG. 9 is a block diagram illustrating another modified fluorescent power supply, in accordance with certain exemplary embodiments of the present invention.

FIG. 9 illustrates another modified fluorescent power supply 602 in accordance with certain other embodiments of the present invention. The fluorescent power supply 602 includes a signal bypass network 902 that is designed to allow power line carrier signals on the input voltage supply 604 to bypass the ballast 606 and to be reintroduced to the lamp voltage supply 608. Any suitable electrical connectors 904 may be used to connect the bypass network 902 to the input voltage 604 feed. By way of example only, such connectors may be vampire clips that are designed to tap into an existing wire. The connector 904 should be designed to allow the transmission of the data signal while restricting the passage of the input voltage 604. The use of the bypass network 902 in this manner would allow the data signals to be extracted from the lamp voltage 608 by the wireless network component 100 at the pins of the fluorescent lamp 102 or at a connector (e.g., 804) within the fluorescent light fixture.

In certain other embodiments, the signal bypass network 902 can be incorporated into the fluorescent power supply 602. In addition, the signal bypass network 902 may in certain embodiments be equipped to communicate with an external device voltage 610 (see FIGS. 6–8) and/or may be connected to a socket or plug (e.g., 706, 802) as shown in FIGS. 7–8. As another alternative, the data and control signal may be removed from the lamp voltage 608 and made available via a separate jack (not shown) mounted to the fluorescent light fixture.

Figure 10:
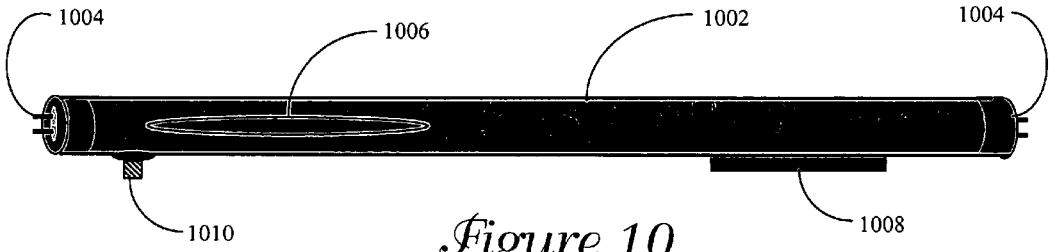
FIG. 10 is an illustration of a wireless network component designed in the shape of a fluorescent lamp, in accordance with certain exemplary embodiments of the present invention.

In still other embodiments of the present invention, the wireless network component 100 may take the shape of a fluorescent lamp 102, as shown by way of example in FIG. 10. The wireless network component 100 may include a housing 1002, having substantially the same shape and dimensions as a fluorescent lamp 102, that contains all necessary and/or desired electronics and/or other equipment. For example, the housing 102 may optionally contain the necessary equipment for power conversion, a heat shield, communications equipment and any other equipment needed for proper operations of the wireless network component 100. At each end of the housing 1002 are power couplings 1004 that mimic the pins of a fluorescent lamp 102. The power couplings 1004 mate with the connectors of the fluorescent light fixture and also connect electrically to the power converter of the wireless network component 100.

Also illustrated in FIG. 10, by way of example only, are various antenna configurations. An antenna may be integrated within the housing 1002 of the wireless network component 100 or externally mounted thereto. Both an integrated antenna 1006 and an externally mounted antenna 1008 are shown in the figure, though both may or may not be necessary in a practical application. The housing 1002 may also be fitted with an external jack 1010 or other connector for receiving a removable antenna. One skilled in the art will be able to envision many other antenna configurations.

In the embodiment shown in FIG. 10, the wireless network component 100 can take the place of one fluorescent lamp 102 within a fluorescent light. Thus, other fluorescent lamps 102 of the fluorescent light could provide illumination while the wireless network component 100 provides wireless signal coverage to the space below. When other fluorescent lamps are not available, or when other wise desired, the housing 1002 of the wireless network component 100 may be configured for other lighting options. For example, a second fluorescent lamp 102 may be externally integrated into the housing 1002, connectors for a removable fluorescent lamp 102 can be affixed to the housing 1002, or LEDs or other light sources can be affixed to or mounted on the housing 1002 to provide illumination to the intended area.

As another alternative, the housing 1002 of the wireless network component 100 may have a length that is less than the fluorescent lamp 102 designed for a particular light fixture. The power coupling 1004 on one end of the shorter housing 1002 may be connected to the light fixture and the power coupling on the other end may be configured for mating with the pins on one end of a shorter (than normally required for the light fixture) fluorescent lamp 102. The pins on the other end of the shorted fluorescent lamp 102 may be connected to the other side of the light fixture as normal. The wireless network component 100 may be wired in serial or parallel with the shorter fluorescent lamp 102.

Fabricating the housing 1002 of the wireless network component 100 in the form factor of a fluorescent lamp 102 would allow the rapid installation of the wireless network component 100 into an existing light fixture. It will be appreciated by those of skill in the art that housing 1002 of the wireless network component 100 may also be adapted to other designs, made more ascetic, optimized for antenna placement or designed to fit into a specific light fixture. Accordingly, the exemplary housing 1002 illustrated in FIG. 10 is merely one envisioned implementation.

Figure 11:
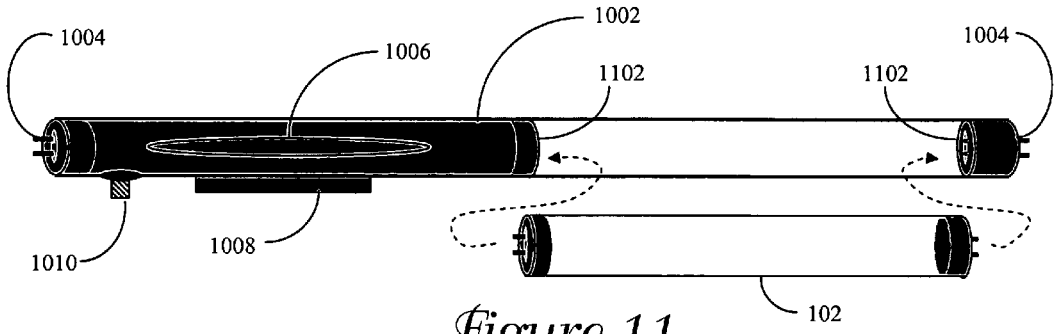
FIG. 11 is an illustration of an alternative embodiment of the present invention, in the wireless network component is housed in a housing shaped like a fluorescent lamp and including a compartment for receiving a shorter fluorescent lamp than is normally required for a particular light fixture.

FIG. 11 illustrates a further alternative embodiment in which the housing 1002 of the wireless network component 100 takes the shape of a fluorescent lamp 102 and includes a compartment for receiving a shorter (than normally required for a particular light fixture) fluorescent lamp 102. Again, the housing 1002 of the wireless network component 100 includes power couplings 1004 that mimic the pins of a fluorescent lamp 102 for mating with the connectors of a light fixture. Internal to the housing 1002 are additional power couplings 1102 that are designed to mate with the pins of the shorter fluorescent lamp 102. The portion of the housing 1002 that surrounds the shorter fluorescent lamp 102 is preferably translucent.

Figure 12:
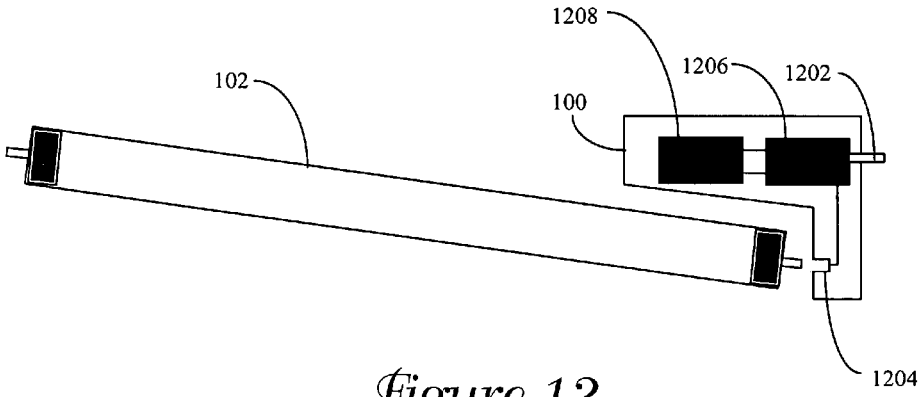
FIG. 12 is an illustration of an exemplary alternative embodiment of the present invention, in which a wireless network component derives power from a single end of a fluorescent lamp and a fluorescent light fixture.

FIG. 12 is an illustration of another alternative embodiment of the present invention, in which a wireless network component 100 derives power from a single end of a linear fluorescent lamp 102 and the connectors within a fluorescent light fixture. The wireless network component 100 has an integrated power coupling, which includes one or more power coupling pins 1202 protruding from one side and a fluorescent lamp pin connector 1204 on the other side. The one or more power coupling pin 1202 is inserted into the connectors of a fluorescent light fixture. The one or more power coupling pin 1202 makes electrical connection with the connectors of the fluorescent light fixture and also supports the wireless network component 100 in its mounting position. Additional supports, such as brackets, fasteners and the like may also be used to support the wireless network component 100 in its mounting position.

The fluorescent lamp pin connector 1204 is designed to receive and make electrical connection with the one or more pin of the fluorescent lamp 102. The one or more power coupling pin 1202 and the fluorescent lamp pin connector 1204 are electrically connected to the power converter 1206 of the wireless network component 100 to complete a circuit. The fluorescent lamp pin connector 1204 is preferably offset vertically (or horizontally) from the one or more power coupling pin 1202. This offset allows the fluorescent lamp 102 to be installed at a slight angle relative to its intended axis within the fluorescent light fixture. Installation of the fluorescent lamp 102 at a slight angle creates additional space within the fluorescent light fixture in which the wireless network component 100 can be mounted.

The power converter 1206 of the wireless network component 100 converts power from the fluorescent light into a voltage that can be utilized for powering the internal electronics 1208 of the wireless network component 100. At the same time, the power converter 1206 allows sufficient power to pass to the fluorescent lamp 102 so that it can continue to provide at least a portion of the intended illumination. Those skilled in the art will appreciate that the shape of the wireless component 100 shown in FIG. 12 is illustrated by way of example only. Other configurations and designs are possible. In addition, the internal electronics 1208 and/or the power converter 1206 of the wireless network component 100 could actually be housed in a separate housing mounted on or near the fluorescent light fixture. The circuit between the one or more power coupling pin 1202 and the fluorescent lamp pin connector 1204 may terminate in a plug, outlet or other power port, to which the separate housing (and/or another external device) could be electrically connected by way of a power cord or power tether 108.

As mentioned above, a wireless network component 100 of the present invention may be used in outdoor locations, for example in conjunction with street lights or security lights common in neighborhoods, campus environments, parking garages, etc. Outdoor lights (and some indoor lights) often include a photoelectric device that prevents power from reaching the lamp (or light bulb) when the ambient light is above a determined threshold. Such a photoelectric device would also prevent power from reaching the wireless network component 100. To overcome this problem, the photoelectric device may be modified so that it does not directly control the power, but instead sends control signals to the wireless network component 100. The control signals would instruct the wireless network component 100 to enable or disable the flow of power to the lamp (or light bulb).

In some embodiments, it may be desirable to include a rechargeable power supplies (e.g., a rechargeable battery) within a wireless network component 100 of the present invention. Power drawn from the power source of a light may be used to simultaneously or alternately charge the rechargeable power supply and power the wireless network component 100. In this way, the wireless network component 100 may continue to operate when the light is turned off. Such an embodiment may be desirable to support network configurations (e.g., mesh networking or peer-to-peer networking) where one wireless network component 100 requires constant communication with another wireless network component 100.

Based on the foregoing, it can be seen that the present invention provides various systems and method for powering a wireless network component 100 from the power source of a light. Many other modifications, features and embodiments of the present invention will become evident to those of skill in the art. It should also be appreciated, therefore, that many aspects of the present invention were described above by way of example only and are not intended as required or essential elements of the invention unless explicitly stated otherwise. Accordingly, it should be understood that the foregoing relates only to certain embodiments of the invention and that numerous changes may be made therein without departing from the spirit and scope of the invention as defined by the following claims. It will be understood that the invention is not restricted to the illustrated embodiments and that various other modifications can be made within the scope of the following claims.

What is claimed is:

1. A power source of a fluorescent light configured for supplying power to an external device, comprising:

a fluorescent ballast for receiving an input voltage via an input line and converting said input voltage to a lamp voltage suitable for illuminating a fluorescent lamp and an external device voltage suitable for powering an external device;

a first output line electrically connecting the fluorescent ballast to connectors within a light fixture for outputting the lamp voltage from the fluorescent ballast to the connectors; and a second output line electrically connecting the fluorescent ballast to a power port for outputting the external device voltage from the fluorescent ballast to the power port.

2. The power source of claim 1, wherein the external device comprises a wireless network component.

3. The power source of claim 1, wherein the power port is integrated within a housing that contains one of the connectors.

4. The power source of claim 1, wherein the power port is mounted on or near the light fixture.

5. The power source of claim 1, further comprising a third output line for extracting network data and control signals from power line carrier signals on the input voltage.

6. The power source of claim 1, further comprising a signal bypass network electrically connected to the input line and to at least one of the first output line and the second output line for allowing power line carrier signals to bypass the fluorescent ballast.

7. The power source of claim 1, wherein the external device is mounted to the fluorescent lamp.

8. The power source of claim 1, wherein the external device is mounted to a surface in proximity to the fluorescent lamp.

9. The power source of claim 1, wherein the power port is configured to receive a plug of the external device, said plug being electrically connected to a power supply of the external device.

10. A power source of a fluorescent light configured for supplying power to an external device, comprising:

a fluorescent ballast for receiving an input voltage via an input line and converting said input voltage to a lamp voltage suitable for illuminating a fluorescent lamp and an external device voltage suitable for powering an external device;

a first output line electrically connecting the fluorescent ballast to connectors within a light fixture for outputting the lamp voltage from the fluorescent ballast to the connectors;

a second output line electrically connecting the fluorescent ballast to a power port for outputting the external device voltage from the fluorescent ballast to the power port; and wherein the power port is integrated within a housing that contains one of the connectors.

11. The power source of claim 10, wherein the external device comprises a wireless network component.

12. The power source of claim 10, further comprising a third output line for extracting network data and control signals from power line carrier signals on the input voltage.

13. The power source of claim 10, further comprising a signal bypass network electrically connected to the input line and to at least one of the first output line and the second output line for allowing power line carrier signals to bypass the fluorescent ballast.

14. The power source of claim 10, wherein the external device is mounted to the fluorescent lamp.

15. The power source of claim 10, wherein the external device is mounted to a surface in proximity to the fluorescent lamp.

16. The power source of claim 10, wherein the power port is configured to receive a plug of the external device, said plug being electrically connected to a power supply of the external device.

17. A method of deriving power for an external device from a power source of a fluorescent light, comprising:

receiving input voltage at a fluorescent ballast, the input voltage comprising power line carrier signals;

separating the power line carrier signals from the input voltage;

converting the input voltage to a lamp voltage suitable for illuminating a fluorescent lamp and to an external device voltage suitable for powering the external device;

outputting the lamp voltage from the fluorescent ballast to connectors within a light fixture; and outputting the external device voltage from the fluorescent ballast to a power port electrically connected to the external device.

18. The power source of claim 17, wherein the external device comprises a wireless network component.

19. The power source of claim 17, wherein the power port is integrated within a housing that contains one of the connectors.

20. The power source of claim 17, wherein the power port is mounted on or near the light fixture.

* * * * *